US006390711B1

(12) United States Patent
Brunetti

(10) Patent No.: US 6,390,711 B1
(45) Date of Patent: May 21, 2002

(54) LIQUID INK WRITING PEN

(75) Inventor: Bruce W. Brunetti, Phillipsburg, NJ (US)

(73) Assignee: Chartpak, Inc., Leeds, MA (US)

( * ) Notice: Subject to any disclaimer, the term of this patent is extended or adjusted under 35 U.S.C. 154(b) by 0 days.

(21) Appl. No.: 09/711,184

(22) Filed: Nov. 13, 2000

(51) Int. Cl.[7] ..... B43K 5/02

(52) U.S. Cl. ..... 401/224; 401/6; 401/1; 401/3

(58) Field of Search ..... 401/1, 3, 6, 223, 401/224, 258; D19/49, 47, 48

(56) References Cited

U.S. PATENT DOCUMENTS

| | | | | |
|---|---|---|---|---|
| 624,853 | A | * | 5/1899 | Oberbeck |
| 811,390 | A | * | 1/1906 | Foreman |
| D87,611 | S | | 8/1932 | Whitehouse |
| D89,815 | S | | 5/1933 | Tefft |
| D94,375 | S | | 1/1935 | Back |
| D99,183 | S | * | 4/1936 | Bowker et al. |
| D99,212 | S | * | 4/1936 | Peters |
| D104,263 | S | | 4/1937 | Holt |
| 2,180,560 | A | | 11/1939 | Stempel |
| D124,248 | S | | 12/1940 | Dreyfuss |
| D136,074 | S | | 7/1943 | Morris |
| D150,224 | S | * | 7/1948 | Green et al. |
| D152,717 | S | * | 2/1949 | Metzler |
| 2,960,066 | A | * | 11/1960 | Kersten |
| D205,645 | S | * | 8/1966 | Lovejoy |
| 3,335,706 | A | * | 8/1967 | Jenkins |
| D213,531 | S | | 3/1969 | Wakai |
| D229,107 | S | | 11/1973 | Wakai et al. |
| 3,824,023 | A | * | 7/1974 | Danjczek et al. ..... 401/258 |
| 3,947,137 | A | | 3/1976 | Hori |
| 3,951,555 | A | | 4/1976 | Wittnebert et al. |
| D240,032 | S | | 5/1976 | Gomez |
| D242,855 | S | | 12/1976 | Grinberg |
| D251,301 | S | | 3/1979 | Malamoud |
| D252,028 | S | | 6/1979 | Carre |
| 4,239,408 | A | | 12/1980 | Mutschler |
| D260,658 | S | | 9/1981 | Chiba |
| D266,258 | S | | 9/1982 | Lockwood et al. |
| D273,017 | S | | 3/1984 | Bertrac |
| D281,512 | S | | 11/1985 | Kobori |
| 4,556,336 | A | * | 12/1985 | Sano et al. |
| D282,553 | S | | 2/1986 | LeBlanc |
| D282,753 | S | | 2/1986 | LeBlanc |
| D283,825 | S | | 5/1986 | Hechter |
| D287,736 | S | | 1/1987 | Henkels |
| D289,425 | S | | 4/1987 | Thevenot |
| 4,671,692 | A | | 6/1987 | Inaba |

(List continued on next page.)

FOREIGN PATENT DOCUMENTS

CH 648518 A5 * 3/1985

*Primary Examiner*—Gregory Huson
*Assistant Examiner*—Khoa Huynh
(74) *Attorney, Agent, or Firm*—Schweitzer Connman Gross & Bondell LLP

(57) ABSTRACT

An inexpensive writing pen for low viscosity liquid inks and formed with an internal ink reservoir and a capillary system for admitting air into the reservoir. The ink reservoir is formed directly by the walls of the pen body, which form an internal cavity. Transfer of heat from the writer's hand into the region of the ink reservoir is inhibited by providing projection elements and intervening air spaces, which form the effective outer surface of the pen body. Preferably, the material of the pen body extends substantially above the upper limits of the internal ink reservoir, and is provided in those upper areas with similar projections and spaces, facilitating transfer of heat from the pen body into the ambient. The arrangement minimizes variations in the pen characteristics resulting from transfer of heat from the user's hand, which can become relatively more acute as the volume of air within the ink reservoir increases as a result of ink consumption. An improved design of unitary nib and collector cartridge is also provided.

5 Claims, 6 Drawing Sheets

U.S. PATENT DOCUMENTS

| | | | | | |
|---|---|---|---|---|---|
| 4,712,937 | A | | 12/1987 | Schmidt et al. | |
| D295,985 | S | | 5/1988 | Grossiord | |
| 4,753,546 | A | * | 6/1988 | Witz et al. | 401/258 |
| 5,056,945 | A | * | 10/1991 | Klodt | 401/6 |
| D324,397 | S | | 3/1992 | von Elder et al. | |
| D331,259 | S | | 11/1992 | Rousseau | |
| D332,626 | S | | 1/1993 | Wada et al. | |
| D333,486 | S | | 2/1993 | Rousseau | |
| D340,474 | S | | 10/1993 | Visage | |
| D342,279 | S | | 12/1993 | Anavil et al. | |
| 5,336,009 | A | | 8/1994 | Young | |
| D359,983 | S | | 7/1995 | Rosenbaum | |
| D363,308 | S | | 10/1995 | Sekine | |
| D363,309 | S | | 10/1995 | Carpani et al. | |
| D363,949 | S | | 11/1995 | Compte | |
| D371,576 | S | | 7/1996 | Compte | |
| D371,805 | S | | 7/1996 | Lee | |
| D396,056 | S | | 7/1998 | Perrin et al. | |
| 5,829,904 | A | | 11/1998 | Matsumoto et al. | |
| D405,467 | S | | 2/1999 | Calvani | |
| 5,927,886 | A | | 7/1999 | Matsumoto | |
| 5,938,362 | A | | 8/1999 | Bastiansen | |
| D414,807 | S | * | 10/1999 | Baudino et al. | |
| D415,525 | S | | 10/1999 | Woerther | |
| D417,700 | S | | 12/1999 | Woerther | |
| 6,062,758 | A | | 5/2000 | Maurer et al. | |
| D428,056 | S | | 7/2000 | Rousseau | |
| D436,127 | S | * | 1/2001 | Hung | |
| 6,261,019 | B1 | * | 7/2001 | Furukawa | 401/223 |

* cited by examiner

FIG. 4
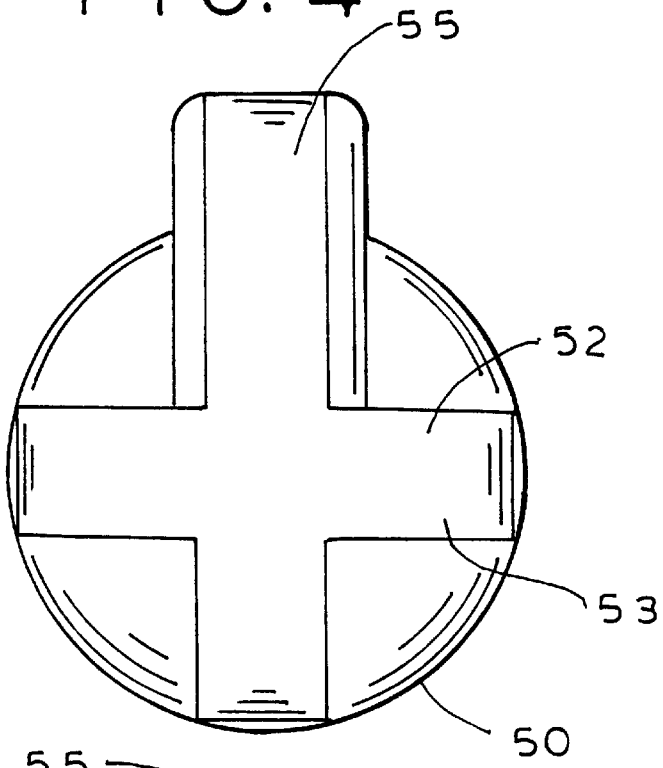
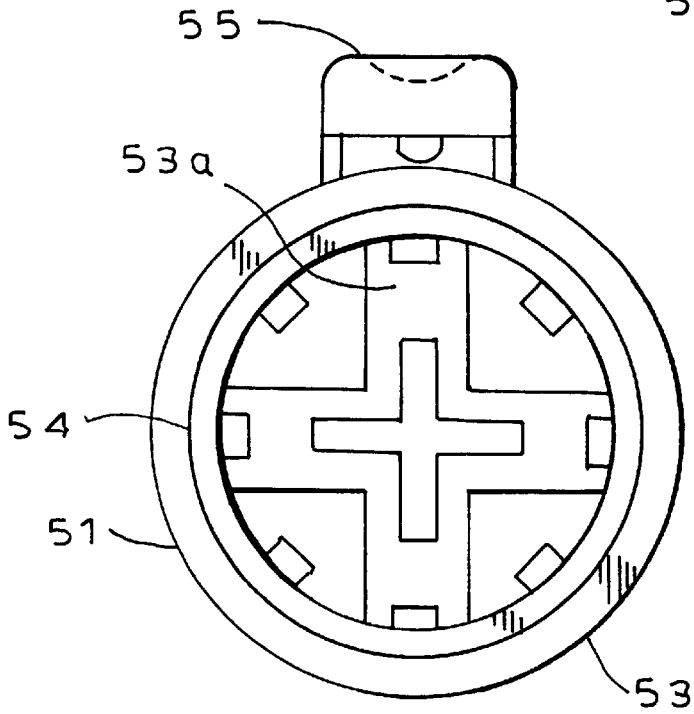
FIG. 8

LIQUID INK WRITING PEN

BACKGROUND OF THE INVENTION

The present invention relates to writing pens and more particularly to writing pens utilizing relatively low viscosity liquid inks particularly, but not necessarily, for stylus or ballpoint pens. Writing pens of this general type, utilizing low viscosity liquid inks, are preferred for many applications over older style ballpoint pens, for example, which utilize a high viscosity ink. The low viscosity inks provide for a much smoother writing action and a more intense written line than the high viscosity inks. When using low viscosity inks, however, special provisions must be made to prevent leakage of the ink and/or to properly control the flow of ink during writing. A generally preferred form of inexpensive pens for this purpose utilizes a so-called vacuum reservoir for the liquid ink, in conjunction with a capillary collector that enables ink to be fed to the writing tip and also enables the reservoir to "breathe" in response to the consumption of ink and/or to changes in temperature and pressure. The general principles of such pens are well known as set forth in, for example, the Wittnebert U.S. Pat. No. 3,951,555.

The present invention provides a writing pen of the general type described above, which can be economically produced and which has superior writing characteristics. More particularly, the invention is directed to a type of writing pen, usually but not necessarily non-refillable, in which an ink reservoir is formed by the main body of the pen. The body is preferably formed of a molded plastic material, closed at one end and open at the other. The open end of the pen body is closed by a collector cartridge, provided with a plurality of closely spaced circular fins or lamellae and capillary passages. A writing element, preferably but not necessarily a ballpoint tip, is mounted at the lower end of the collector cartridge and is provided with a capillary rod which extends into a central through passage in the collector cartridge and thus communicates with the ink supply contained in the pen body reservoir, above the collector cartridge.

As ink is consumed from the reservoir, it is replaced by air drawn in through the collector cartridge. Both the ink in the reservoir and the air above the ink are influenced by changes in temperature. In a pen construction in which the primary pen body forms the ink reservoir directly, as distinguished from constructions in which there is a separate ink-holding cartridge contained within the pen body, heat from the hand of the user tends to be conducted into the pen body, heating both the ink and the air contained in the reservoir. As will be appreciated, this can have a variable influence on the manner in which the pen operates. Experience shows that this variability becomes more acute as ink is consumed, because the air volume contained in the reservoir is more responsive to changes in temperature than the ink itself, and that variability becomes more acute as the relative amounts of air in the reservoir increase in the course of ink consumption.

SUMMARY OF THE INVENTION

Pursuant to the present invention, the body of the pen is designed with outwardly extending elements, preferably formed by deep flutes or grooves in the upper portion of the pen body. This includes the region of the internal reservoir and preferably also that portion of the pen body above the reservoir, in cases where the reservoir occupies only a portion of the pen body. The outwardly extending elements, e.g., deep flutes or grooves, perform two functions: The first is to form an interrupted outer surface of the pen body, to restrict the area of contact between the pen body and the hand of the user, particularly in the region of the ink reservoir. This serves to limit and restrict the transfer of heat from the user's hand into the ink and/or air contained within the reservoir. Secondly, the outwardly extending flutes, grooves or other elements provide significantly greater exposed surface area for radiating and conducting heat away from the pen body so that heat that is unavoidably added by reason of the writer's grip can be more efficiently dissipated. In an inexpensive pen of the type contemplated, where the pen body itself forms the reservoir for the liquid ink, there is a direct path for the conduction of heat from the outside of the pen body to the interior of the reservoir. Particularly where a substantial portion of the ink has been consumed, and the air volume is relatively large, heat input from the user's hand can result in significant expansion of the air volume, tending to force the low viscosity ink out of the main reservoir and into the collector cartridge. While the intended purpose of the collector cartridge is to temporarily receive ink displaced by such expansion, excessive amounts of such expansion can be deleterious to the performance of the pen and are minimized by the pen construction of the invention.

It is contemplated that the new pen will be furnished with inks of various colors, for artists, etc. To this end the pen is provided with a nib which is color coded to indicate the color of the ink contained within the pen. Additionally, a novel cap is provided, which fully exposes the colored nib and enables the artist to quickly ascertain the pen's color without either removing the cap or rotating the pen to a position in which the nib may be viewed through a special window. The pen body and cap may be made out of a material of common color (e.g., black) to achieve economies of manufacture, while at the same time enabling the user to ascertain ink color by simply viewing the cap.

A preferred form of the invention also includes an improved nib-collector cartridge designed to facilitate precision molding procedures. To this end, the cartridge includes an axially extending, generally tubular gate element at its upper end, formed with an opening at one side to accommodate ink flow and mold ejection.

For a more complete understanding of the above and other features and advantages of the invention, reference should be made to the following detailed description of a preferred embodiment, and to the accompanying drawings.

DESCRIPTION OF THE DRAWINGS

FIG. 4 is an end elevational view from the cap end of the pen of FIG. 1.

FIG. 8 is an end view of the cap, viewed from its open end.

DESCRIPTION OF PREFERRED EMBODIMENTS

Figure 1:
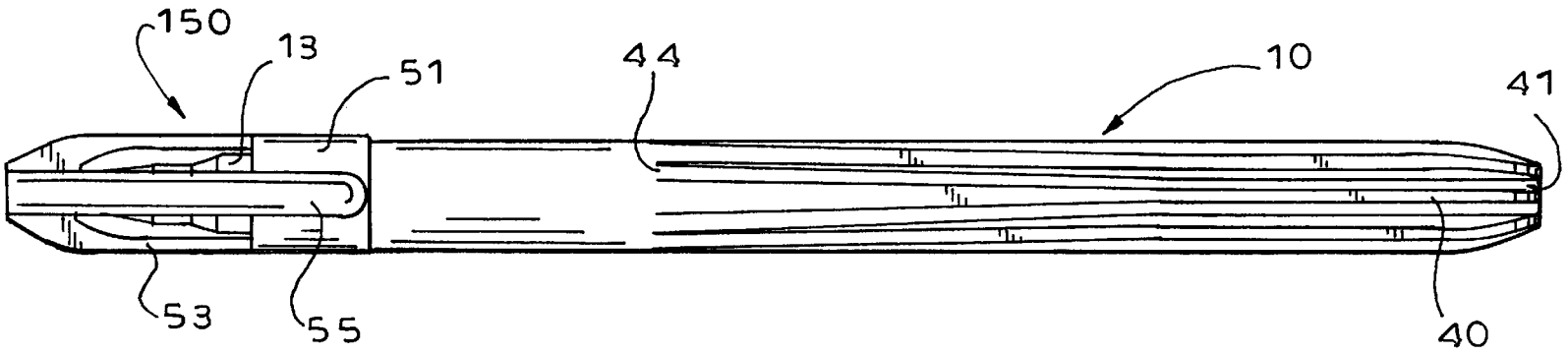
FIG. 1 is a elevational view of a writing pen according to the invention.

With reference now to the drawing, the pen of the invention preferably comprises three principal components, a pen body 10, a combination nib and collector cartridge designated generally by the reference numeral 11, and comprised of an integral molding of a collector portion 12 and a nib portion 13. A writing tip 14, preferably, but not necessarily, with a ball tip 15, is mounted at the lower end of the nib 13.

Figure 2:
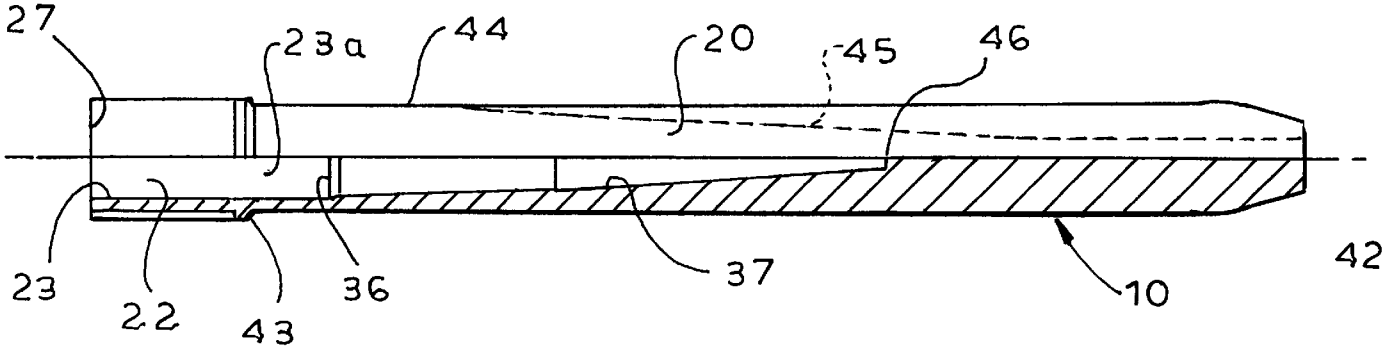
FIG. 2 is a longitudinal cross sectional view as taken generally on line 2—2 of FIG. 1, taken along the pen body only.
Figure 10:
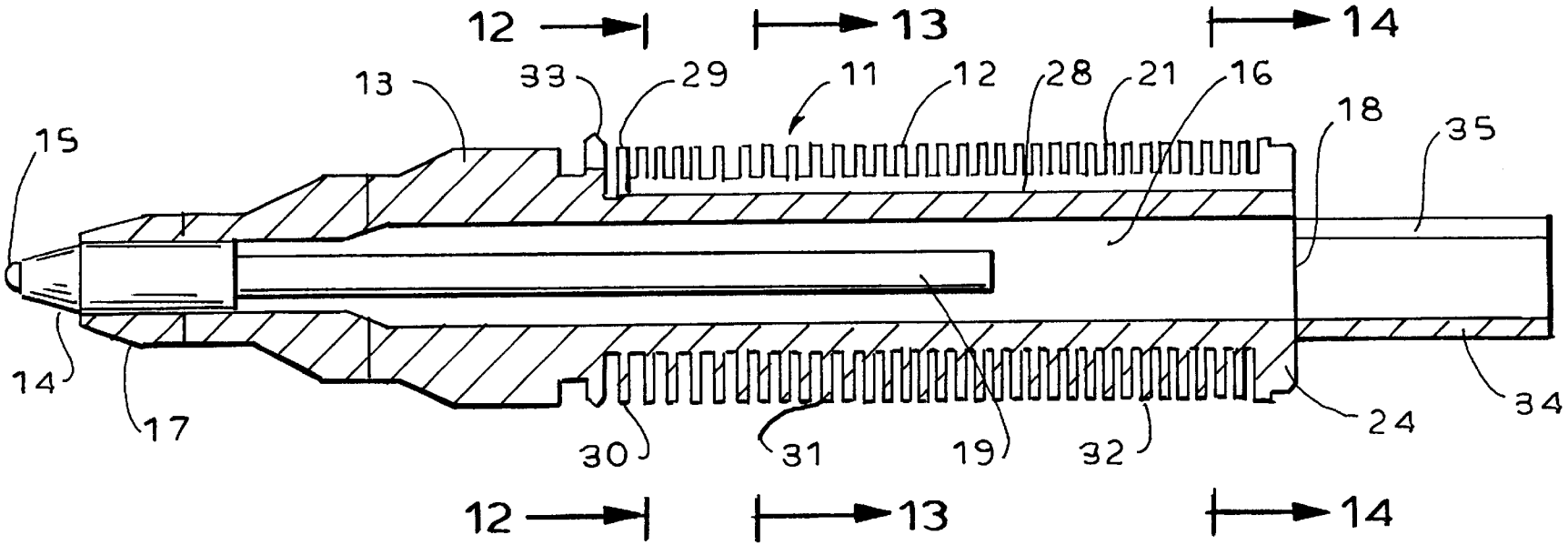
FIG. 10 is a longitudinal cross sectional view of the cartridge of FIG. 9.

As shown in FIG. 10, the nib-collector cartridge 11 is formed with a central passage 16 extending from the lower end 17 of the cartridge to its upper extremity 18. A capillary rod 19 mounted in the writing tip, extends upward in the central passage and is in communication through said passage with an ink reservoir cavity 20 formed in the pen body 10 (FIG. 2).

The collector cartridge 11 includes a series of closely spaced disc-like lamellae 21 which, when the cartridge is inserted into the lower end 22 of the pen body, provide a relatively close fit (typically with a small clearance) with the internal walls 23 of the lower end chamber 23*a*. The cartridge is formed with a flange 24 at its upper end, which forms a relatively tight fit with the chamber walls 23, so that the cartridge is tightly held in its assembled relation with the pen body, after the initial assembly. Adjacent the lowermost lamellae is an end flange 26 which is tightly received in the lower end extremity 27 of the pen body to support and position the collector cartridge.

In accordance with known general principles, a capillary communication is provided between ambient air and the reservoir cavity 20 to allow for air to be drawn into the reservoir as ink is consumed therefrom, and also to accommodate a limited degree of "breathing" of the ink system in response to thermal expansion and contraction. The allowance for air to enter the reservoir of course carries the related problem of preventing ink from flowing out of the reservoir. The general techniques for accomplishing this are known and are explained for example in the before-mentioned U.S. Pat. No. 3,951,555.

Figure 13:
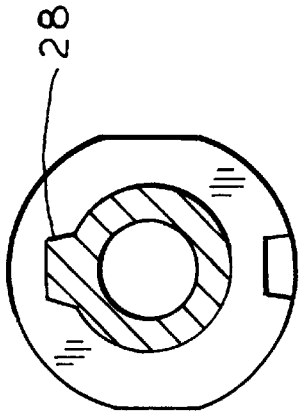
FIGS. 12–14 are cross sectional views taken generally on lines 12—12, 13—13, 14—14 respectively of FIG. 10.
Figure 14:
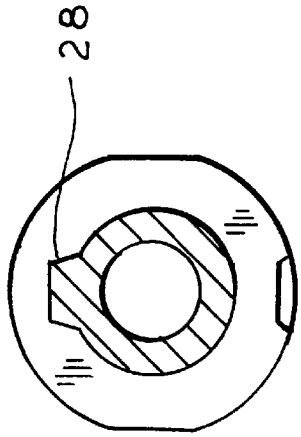
Figure 12:
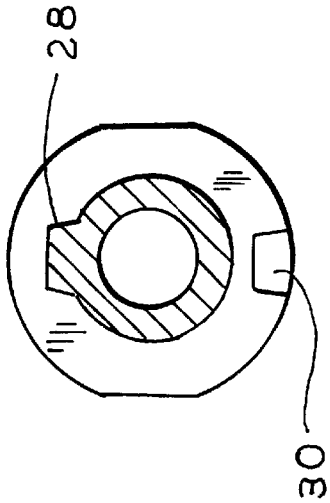
Figure 11:
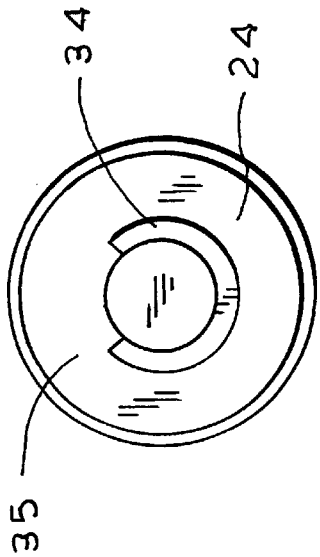
FIG. 11 is an end view of the cartridge of FIG. 9, viewed from the upper end.

In the illustrated form of the invention, the disc-like lamellae are provided in several regions, providing spaces or vents of different width. In the illustrated arrangement, the five lowermost spaces are each approximately 0.020 inch in width. The next six spaces above are somewhat narrower, approximately 0.016 inch in width, and the uppermost region is comprised of twenty-one spaces of still narrower dimensions, each approximately 0.012 inch in width. A capillary slot 28 extends longitudinally, through the flange 24 and through all of the lamellae except the lowermost one designated with the numeral 29. On the side of the cartridge opposite the capillary slot 28, there is an air passage formed by notches of progressively decreasing depth in the various lamellae, being deepest in the lower portions and least deep in the upper portions. Thus, as shown in FIG. 12, the lowermost lamellae 29, and the four lamellae adjacent to it are formed with notches 30 (FIG. 12) which, for a typical pen, might have a depth of about 0.042 inch and width of about 0.079 inch. Medium depth notches of about 0.029 inch and width of about 0.079 inch are formed in the next seven lamellae (FIG. 13), and shallow notches of about 0.013 inch depth and 0.079 width are formed in the uppermost twenty lamellae (FIG. 14). An entry notch 33 can be formed in the lower flange 26, for communicating with the ambient.

In the illustrated form of the invention, the nib and collector cartridge portions advantageously are formed as a unitary plastic molding, of a material such as ABS formed in a precision injection molding. This is a complex molding, and significant advantages can be realized by providing a gate element, in the form of a partial tube 34, extending axially from the upper end flange 24 of the cartridge. The gate tube preferably has an internal diameter corresponding to the internal diameter of the central passage 16, as indicated in FIG. 10. The gate tube is open along one side 35 over its entire length, so that it does not form a barrier to the flow of ink into the passage 16. An opening 34*a* in provided in the side wall of the tube, accessible from the open side 35, for engagement by an ejection pin at the end of the molding process.

With reference to FIG. 2, a typical pen body for a pen of convenient size may be about five inches in length, with an outer diameter of somewhat less than one half inch. The pen body 10 advantageously is an injection plastic molding of a material such as polypropylene. Internally, the walls of the pen body are formed with a shoulder 36 which forms a positioning abutment for the upper flange 24 of the cartridge 11. Typically, the collector cartridge is inserted into the pen body for a distance of around one inch. Directly above the shoulder 36, and extending for a distance of about 1.5 inches in the illustrated device, is the ink reservoir cavity 20, which is defined by upwardly convergent inner walls 37 of the pen body 10.

In the use of the assembled pen, the user's hand surrounds the lower portion of the pen body, typically with the thumb and forefinger, and perhaps portions of the index finger engaging and gripping the lowermost portions. Portions of the pen body higher up along its length typically are cradled by the hand, in the region between the thumb and forefinger. The temperature of the user's hand typically is higher than ambient, resulting in a tendency for heat to flow into the pen body. In a pen of the type illustrated, since walls of the pen body directly form the ink reservoir (as distinguished from merely encasing a separate ink cartridge), heat conducted into the pen body enters the reservoir and tends to heat not only the ink but the air contained in the reservoir above the level of the ink. Changes in the temperature of the ink can result in changes to its flow characteristics, and the system is also very sensitive to changes in the temperature of the air, which tends to expand and contract readily as a function of its temperature. As will be appreciated, the greater the volume of air within the reservoir, the more significant will be variations resulting in changes in the temperature thereof. Since the volume of air inherently increases with progressive use of the ink supply, performance variations in relation to temperature variations can become relatively more acute as the ink is consumed.

Figure 3:
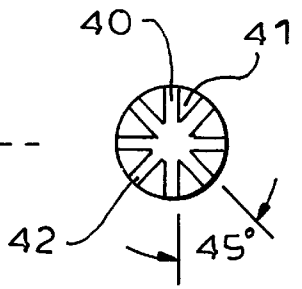
FIG. 3 is an end elevational view of the pen showing the configuration of the pen body.
Figure 5:
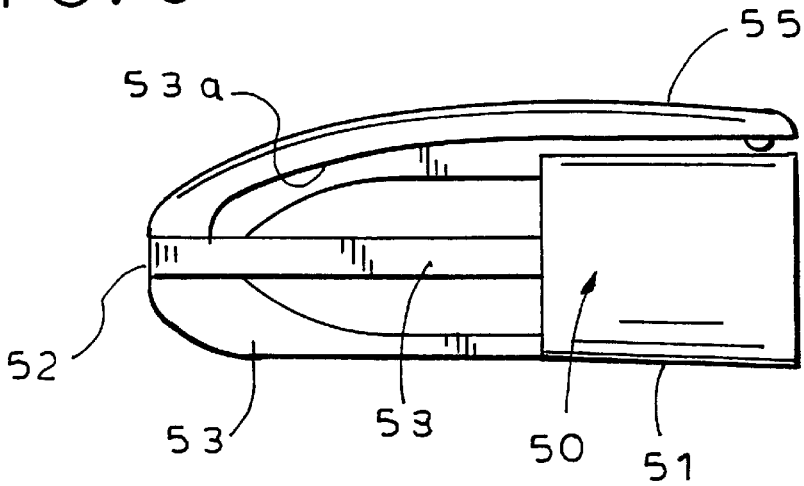
FIG. 5 is a side elevational view of an advantageous form of pen cap according to certain aspects of the invention.

In a preferred embodiment of the invention, the pen body is provided over its outer surface, and typically as much of such surface as is practicable under the circumstances, with projection elements 40 separated by intervening spaces or grooves 41, with the outer surfaces 42 of the projection elements collectively forming the outer contact surfaces of the pen body. Desirably the surface contact area provided by the rib surfaces 42 is smaller than the area of the intervening groves or spaces 41 at the level of the surfaces 42. In the illustrated form of the invention, the projection elements advantageously are in the form of longitudinally extending radial ribs. In the illustrated device, as shown in FIGS. 1 and 3, there are eight such longitudinal ribs 40, separated by deep grooves 41.

In the lowermost portions of the pen body, in which the collector cartridge is received, the side wall 43 of the body is relatively thin and can be formed with a more or less conventional, relatively smooth surface. Starting in the region of the reservoir cavity 20, at approximately the point 44 along the pen body as shown in FIG. 2, grooves 41 of minimum depth commence. As the grooves progress upward along the pen body, they become progressively deeper, as indicated by the broken line 45 in FIG. 2. In general, the grooves 41 are deepened as much as practicable, without unduly weakening the side wall of the pen. At about the region of the uppermost extremity 46 of the ink reservoir, the upper portion of the pen body becomes solid, and the grooves 41 can be of maximum depth.

In a pen of the proportions indicated, having a diameter slightly less than one half inch and a pen body length of around five inches, at least upper extremities of the pen body will extend beyond areas of contact with the hand. Additionally, the portion of the pen body cradled with the thumb and forefinger will make only limited contact with outer surfaces of a few ribs, while the ribs of the entire upper portion of the pen body remain exposed to the ambient. Thus, heat input into the cradled portion of the pen body is minimized, and transfer of heat back into the ambient via radiation and convection through the exposed surface area of the ribs 40 is maximized.

While in the illustrated form of the invention, the projection elements 40 have been illustrated as longitudinally extending radial ribs, it will be understood that this is a preferred and advantageous configuration. The projection elements in principle can be in circular or spiral configuration, a matrix of individual projection elements in the forms of outwardly projecting cones, cylinders, etc. The specific configuration is not known to be critical. The general principle provides that there be a limited contact between the pen body and the upper portion of the hand, and that there be significant exposed non-contact surface area and air passage area, enabling heat to be radiated and convected from the pen body into the atmosphere during use, in order to minimize temperature variations within the ink reservoir.

Figure 6:
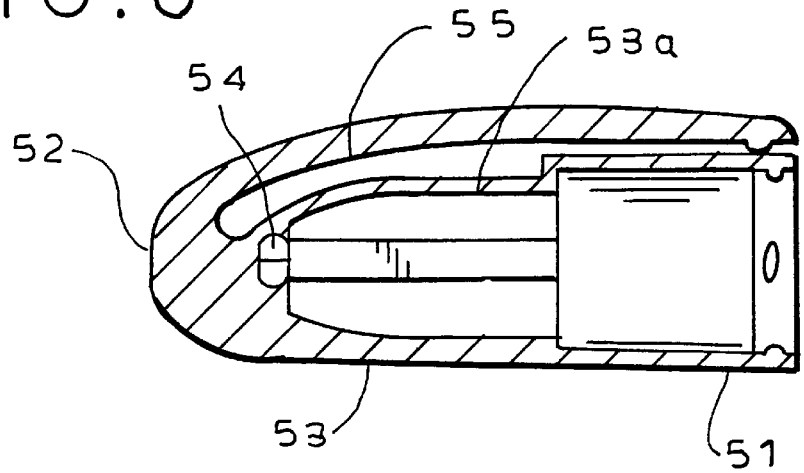
FIG. 6 is a longitudinal cross sectional view of the pen cap of FIG. 5.
Figure 7:
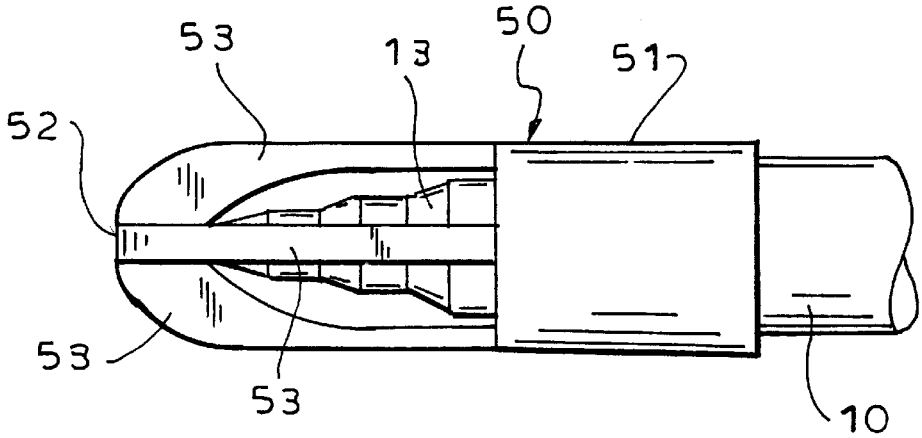
FIG. 7 is a bottom view of the cap of FIG. 5, shown installed at the lower end of a pen.
Figure 9:
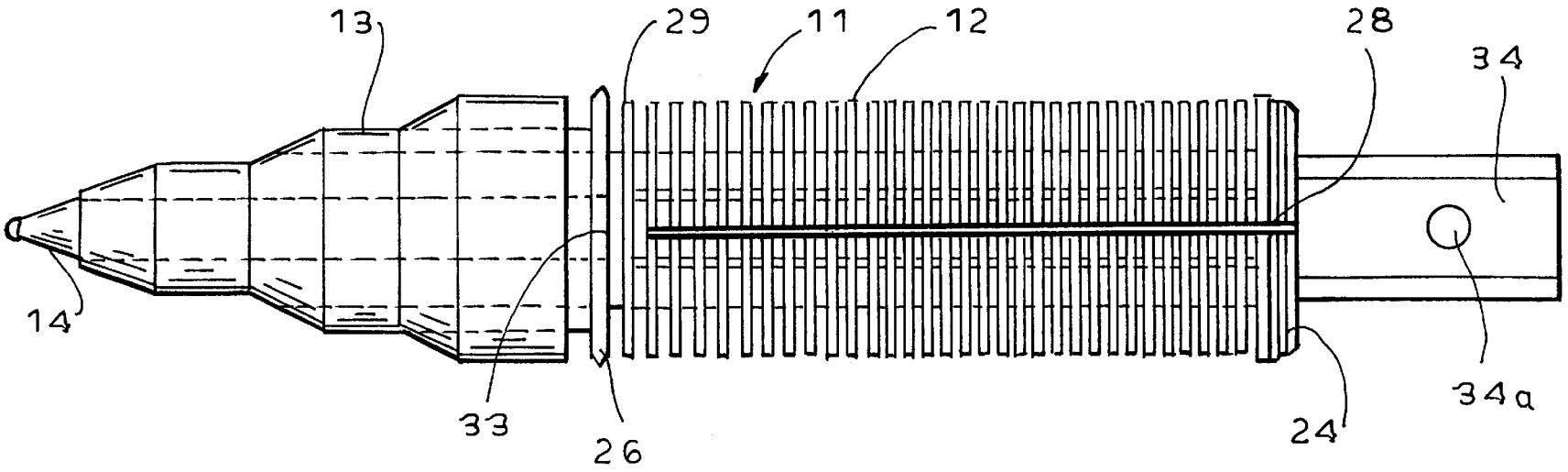
FIG. 9 is an elevational view of a combination nib and collector cartridge incorporating certain improved features.

A preferred embodiment of the invention includes a novel pen cap that enables the nib 13 of the pen to be almost completely visible from any position, when the cap is in place. In order to identify the color of ink in the pen, it is desireable to form the nib 13 of a corresponding color. At the same time it is desireable from the standpoint of economy of manufacture to form the pen body and cap out of a common color of material (e.g., a black plastic, such as polypropylene), regardless of the color of the ink inside the pen. In the illustrated and preferred embodiment of the invention, the pen cap 50 (FIG. 4–8) is designed with a "bell tower" configuration, comprising a cylindrical retaining ring 51 at one end and an end cap 52 at the opposite end. Connecting the retaining ring and end cap are a plurality, preferably four, of narrow (for example 0.13 in, for a cap of about ½ inch in diameter) support elements 53, 53*a*. The retaining ring is adapted to be positioned on the lower end of the pen body, the terms "lower" and "upper" in this respect relating to the pen in a usable position, with its nib pointing down. As shown in FIG. 7, when the cap in installed on the pen body, the position of the retaining ring 51 is such that almost the entire nib 13 is exposed beyond the lower end of the ring and is visible through the wide spaces between the support elements 53, 53*a*.

In the illustrated embodiment, in which there are four support elements 53, 53*a*, they are spaced 90 degrees apart and form wide spaces in between. This provides easy visual access to the nib 13 from virtually any position, without requiring any manipulations of the pen, and thus enables the ink color to be easily determined without opening the pen or even, in most cases, even touching it. As will be apparent in FIG. 7, the surface area of the support elements is quite small in relation to the projected surface area of the open spaces in between, and this condition should be retained in any design and configuration of the support elements.

Desirably, the end cap portion 52 of pen cap is provided on the inside with a socket 54 for receiving an elastic sealing element (not shown) of silicone or similar material that will engage and cover the tip 14–15 of the pen when the cap is applied.

In a typical pen construction, the pen cap frequently is provided with a pocket clip, and such a clip if provided on the clip of the invention. As shown in FIG. 6, a pocket clip 55 is formed as an integral part of the end cap 52 and extends therefrom along the outside of the cap and over the retaining ring 51 to a point near the upper edge thereof. The clip is designed to cooperate with the outer surface of the retaining ring 51 to provide the desired engagement with a pocket or the like. To particular advantage, the pocket clip 55 is aligned directly over the top of the support element 53*a* so as to minimize any interference with visual access to the nib 13. As indicated in FIG. 4, the pocket clip 55 may of necessity by slightly wider than the narrow support elements, but it still provides the desired high degree of visual access to the nib.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A liquid ink pen which comprises, (a) an elongated pen body having side walls forming a hollow interior portion, an exterior surface of said pen, an open lower end, and a closed upper end, (b) said hollow interior portion defining reservoir for liquid ink, in which the ink is in direct contact with inner surfaces of said side walls, (c) a collector element having upper and lower ends and being at least partly received in the hollow interior portion of said pen body adjacent to the open lower end thereof, (d) the upper end of said collector element cooperating with the inner surfaces of said pen body side walls to seal one end of said ink reservoir, (e) said ink reservoir extending upward within said pen body from a region adjacent the upper end of said collector element toward said closed upper end, (f) a writing point communicating through said collector element with said ink reservoir, (g) said collector element having capillary passages for admission of ambient air into said ink reservoir and for temporary containment of liquid ink expelled from said ink reservoir, (h) outwardly extending projection elements and intervening air spaces integrally formed in regions of said pen body surrounding said ink reservoir, (i) said projection elements comprising a plurality of outwardly extending ribs, (j) said ribs extending longitudinally along said pen body and projecting radially therefrom, (k) said intervening air spaces comprising grooves located between and separating said ribs, (l) said ink reservoir having an upper end portion, (m) said pen body having an upper portion extending upward for a substantial distance beyond the upper end portion of said ink reservoir, (n) said ribs and grooves extending substantially throughout the upper portion of said pen body, and (o) said grooves being shallow in a region immediately surrounding said ink reservoir and deeper in a region of said upper portion of said pen body above said ink reservoir, wherein said ribs being sufficient in number and extent that outer surfaces of said ribs effectively constitute outer contact surfaces of the pen body in a region of said ribs for contacting said pen by the hand of a user during use of the pen, whereby transfer of heat from a user's hand into said ink reservoir is limited, and transfer of heat away from said pen body is enhanced.

2. A pen according to claim 1 wherein (a) said ink reservoir has a relatively maximum diameter in lower portions thereof and tapers to relatively progressively lesser diameters in an upward direction from said lower portions, and (b) said grooves are relatively deeper in regions of said pen body surrounding portions of lesser diameters of said ink reservoir.

3. A pen according to claim 1, further including a nib and collector cartridge formed of a unitary plastic molding and defining, (a) a nib structure at one end of the cartridge, for mounting of a writing element, (b) a collector structure joining said nib structure and comprised of a plurality of closely spaced disc-like lamellae, (c) said cartridge having a central passage from one end to the other thereof, (d) a gating element of generally tubular configuration and having a generally tubular side wall extending axially from an upper end of said cartridge, and (e) said generally tubular gating element having an opening in said side wall closely adjacent said upper end.

4. A cartridge according to claim 3 wherein (a) said opening extends over the full axial length of said side wall.

5. A cartridge according to claim 4 wherein (a) said opening comprises a segment of said side wall covering an arc or about 90 degrees.

* * * * *